United States Patent [19]

Kolaian et al.

[11] 3,979,307

[45] Sept. 7, 1976

[54] FABRIC SOFTENER COMPOSITION

[75] Inventors: Jack H. Kolaian, Wappingers Falls; Ronald E. Jones, Glenham; Wheeler C. Crawford; William M. Cummings, both of Fishkill, all of N.Y.

[73] Assignee: Texaco Inc., New York, N.Y.

[22] Filed: Sept. 10, 1973

[21] Appl. No.: 395,464

Related U.S. Application Data

[63] Continuation-in-part of Ser. No. 290,687, Sept. 20, 1972, abandoned.

[52] U.S. Cl. ..... 252/8.75; 252/8.8; 260/457; 260/459 A; 260/567.6 M; 260/925; 424/199; 424/303

[51] Int. Cl.[2] ..... D06M 13/46

[58] Field of Search ..... 252/8.75, 8.8, 8.9, 252/355; 260/567.6 M, 459 A, 925; 117/139.5 C, 139.5 Q

[56] References Cited

UNITED STATES PATENTS

| | | | |
|---|---|---|---|
| 2,054,257 | 9/1936 | Hueter | 252/8.75 |
| 3,154,489 | 10/1964 | Dubrow et al. | 252/8.75 |
| 3,349,033 | 10/1967 | Zuccarelli | 252/8.8 X |
| 3,470,252 | 9/1969 | Doyle et al. | 260/583 M |
| 3,537,993 | 11/1970 | Coward et al. | 252/8.75 |
| 3,591,405 | 7/1971 | McCarty | 252/8.8 |
| 3,625,891 | 12/1971 | Waldman et al. | 252/8.75 X |
| 3,703,480 | 11/1972 | Grand et al. | 252/8.75 X |

*Primary Examiner*—Herbert B. Guynn
*Attorney, Agent, or Firm*—T. H. Whaley; C. G. Ries; Robert A. Kulason

[57] ABSTRACT

A composition for imparting softness to fabrics by utilizing an aqueous dispersion of a di(secondary alkyl) ammonium sulfate or phosphate.

8 Claims, 1 Drawing Figure

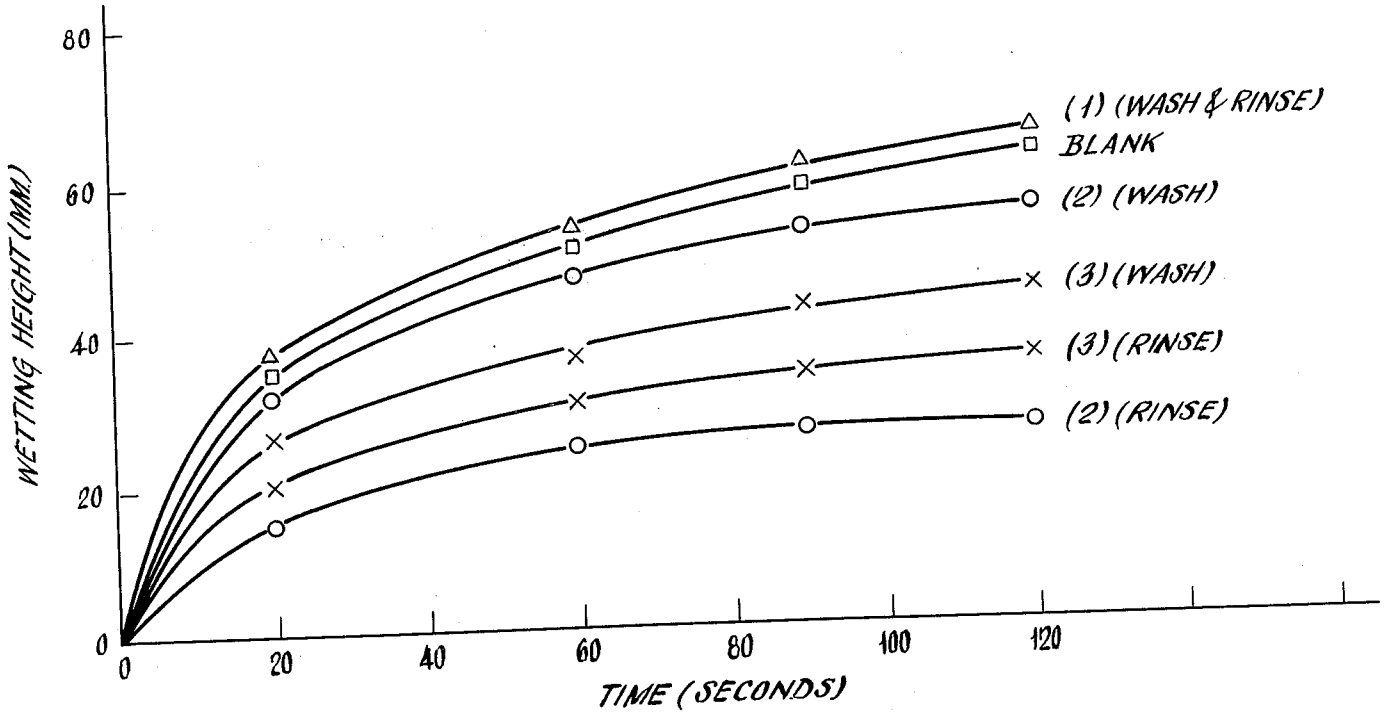
(1) (WASH & RINSE)
BLANK
(2) (WASH)
(3) (WASH)
(3) (RINSE)
(2) (RINSE)
WETTING HEIGHT (MM)
80
60
40
20
0
0
20
40
60
80
100
120
TIME (SECONDS)

FABRIC SOFTENER COMPOSITION

This application is a continuation-in-part of our copending application Ser. No. 290,687 which was filed on Sept. 20, 1972, now abandoned.

BACKGROUND OF INVENTION

Fabric softeners are widely used by home consumers, commercial laundries and textile manufacturers. It is desired that such softeners provide softness, surface smoothness, good draping qualities, fluffiness and antistatic properties while avoiding surface greasiness or excessive build-up on the fabric. Although the literature on fabric softening is fairly extensive, the exact softening mechanism is not known. One commonly accepted mechanism relates softness to the lubricity of the adsorbed softener on the cloth and the consequent reduction of friction between the fabric fibers. Prior art softeners include cationic amides, amino esters, di-(hydrogenated tallow) dimethyl quaternary ammonium salts and fatty substituted imidazoline salts.

SUMMARY OF THE INVENTION

It is the primary object of this invention to formulate novel fabric softener compositions based on di(secondary alkyl) ammonium phosphate and sulfate.

It is a further object to effectively soften a wide variety of fabrics by means of the aforementioned fabric softener compositions.

Various other objects and advantages of this invention will be readily apparent from the following detailed description thereof.

We have now discovered that the use of di(secondary alkyl) ammonium ester derivatives, as hereinafter defined, as the primary softening component of fabric softening compositions enables such compositions to provide satisfactory softening properties to the fabrics treated therewith. Thus, the treated fabrics exhibit softness, surface smoothness, good draping qualities, fluffiness and antistatic properties while avoiding greasiness and softener build-up on the surface thereof.

The drawing shows a comparison of the wettability properties of fabrics treated with a di(secondary alkyl) ammonium ester derivative of the present invention and fabrics treated with two commercially available fabric softeners.

DESCRIPTION OF THE PREFERRED EMBODIMENTS

The fabric softeners of this invention are characterized by the formula:

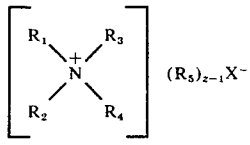

$(R_5)_{z-1}X^-$ wherein $R_1$ and $R_2$ are secondary alkyl groups of from 10 to 30 carbons each;

$R_3$ is selected from hydrogen, methyl and $-(CH_2CH_2O)_nH$ with $n = 3$;

$R_4$ and $R_5$ are selected from alkyl, aryl and aralkyl radicals of from 1 to 10 carbons;

X is an anion selected from the group consisting of sulfate and phosphate; and $z$ is an integer equal to the valence of X.

Specific examples of this class of compounds include: methyl di($C_{10}$–$C_{14}$ secondary alkyl) ammonium methyl sulfate, dimethyl di($C_{10}$–$C_{14}$ secondary alkyl) ammonium methyl sulfate, dimethyl di($C_{14}$–$C_{15}$ secondary alkyl) ammonium methyl sulfate, methyl monoethoxylated di($C_{10}$–$C_{14}$ secondary alkyl) ammonium methyl sulfate, methyl monoethoxylated di($C_{10}$–$C_{14}$ secondary alkyl) ammonium dimethyl phosphate, dimethyl di($C_{16}$–$C_{20}$ secondary alkyl) ammonium methyl sulfate, dimethyl di($C_{20}$–$C_{23}$ secondary alkyl) ammonium methyl sulfate, ethyl di($C_{10}$–$C_{14}$ secondary alkyl) ammonium ethyl sulfate, methyl phenyl di($C_{10}$–$C_{14}$ secondary alkyl) ammonium diphenyl phosphate, and methyl benzyl di($C_{10}$–$C_{14}$ secondary alkyl) ammonium dibenzyl phosphate. The foregoing carbon ranges describing the secondary alkyl denote the above listed phosphate and sulfate softener products are in essence mixtures of compounds differing in secondary alkyl chain length within the designated range.

In general, the procedure for preparing the fabric softeners of this invention involves the initial preparation of the di(secondary alkyl) amine component and the subsequent reaction of the amine component with an ester selected from the group consisting of dialkyl, diaryl and diaralkyl phosphate or sulfate wherein the anionic component of the salt is the identical anionic component found in the final product.

As indicated above, the amines utilized in the preparation of the softeners are substituted with two secondary alkyl groups of from 10 to 30 carbons each. Typical secondary alkyl groups include: $C_{14}$–$C_{15}$ and $C_{10}$–$C_{14}$: other alkyl groups are the fractions containing 16–20 carbon atoms, 20–23 carbon atoms, etc., such as those which are obtained from mixed nitroparaffins by reduction of the nitro group. That is, the alkyl group is not obtained as a pure compound but rather as the mixture of alkyl groups corresponding to the fraction of the paraffins which are nitrated and then reduced to amines in the process of making these compounds. Such secondary alkyl amines are generally prepared by the nitration of normal paraffins followed by the hydrogenation of the resulting paraffins. These amines are recovered as mixtures of amines exhibiting differing carbon chain lengths, these amine mixtures being perfectly acceptable for subsequent reaction according to this invention.

By way of further illustration, the preparation of suitable secondary alkyl primary amine precursors for use herein is described in U.S. Pat. No. 3,470,252. The procedure described includes nitration of paraffin hydrocarbon fractions containing 10 to 14 carbons ($C_{10}$–$C_{14}$), 14 to 15 carbons ($C_{14}$–$C_{15}$), 16 to 18 carbon atoms ($C_{16}$–$C_{18}$), 17 to 20 carbons ($C_{17}$–$C_{20}$), 19 to 22 carbons ($C_{19}$–$C_{22}$) and the like. Nitration is effected so that the nitro group is randomly distributed along the paraffin chain providing, in turn, the (secondary alkyl) primary amine when converted thereto in a sequential hydrogenation step. The (secondary alkyl) primary amine may be reacted further in situ to form the desired di(secondary alkyl) secondary amine, or recovered from the initial hydrogenation reaction product mixture and reacted at an elevated temperature, illustratively 190° to 220° C. in a hydrogen atmosphere of 50 pounds per square inch gauge (psig) to 1000 psig over a reduced nickel/nickel oxide catalyst supported on kieselguhr, and in which the ratio of reduced nickel to total nickel present is 0.6 to 1 respectively. Ammonia, as well as gaseous hydrogen, is most desirably removed from the reaction vessel as the reaction proceeds. The secondary alkyl secondary amine is also conveniently prepared by heating two mols of primary amine to about 200° C. in the presence of about 4.0 weight percent of Raney nickel. The latter method is less preferred. The secondary alkyl secondary amine precursors employed in preparing the quaternary softeners of this invention are those, as indicated above, wherein the alkyl substituents contain from about 10 to 30 carbon atoms.

The foregoing secondary alkyl amine precursors are characterized by low freezing points and pour points and will consequently permit greater efficiency in handling compared, for example, to the higher melting fatty amines derived from fatty acids, a difference, it has been discovered, that is carried through into the corresponding quaternary ammonium phosphate and sulfates.

Where it is desired to prepare alkoxylated derivatives, the di(secondary alkyl) amine is reacted with an alkylene oxide in the presence of either acidic catalysts such as $SbCl_5$, $BF_3$, p-toluene sulfonic acid, and the like; or basic catalysts such as alkali metal hydroxides, RONa ($R = CH_3$, $C_2H_5$), metallic sodium and the like or in the absence of catalytic assistance but under stringent reaction conditions. These reactions are generally conducted in a closed reaction system, in an inert atmosphere such as nitrogen, and at elevated temperatures and pressures. The relative concentrations of the amine and alkylene oxide will generally be determined on the basis of the stoichiometric equivalencies of the reaction.

The amines are then reacted with the appropriate esters, a dihydrocarbyl sulfate or trihydrocarbyl, for example, according to conventional procedures to prepare the ammonium ester derivative softeners of this invention. Typical esters include dimethyl sulfate, diethyl sulfate, dipropyl sulfate, dibutyl sulfate, diphenyl sulfate, trimethyl phosphate, triethylphosphate, tripropylphosphate, tribenzylphosphate and the like. These reactions are generally conducted in a solvent such as amyl cyanide at temperatures ranging from about 30° to 60° C., and indeed upward to about 80° C., preferably at about 50° to 80° C. and for periods of from about 45 minutes to 1 1/2 hours, and for as long as 10 hours. The solvent is removed at the end of this period by reducing the pressure in the reaction chamber to, for example, 2 millimeters Hg. The recovery of desired quaternary salt using this procedure is 90 percent and higher on a mole basis. Yields of 100 percent have, in fact, been recovered.

With respect to proportions, the amine and ester are present in molar ratio ranging from about 1:1 to 2:1 and preferbly about 1:1. The product is in essence a mixture of compounds with the ammonium ester derivative predominating. Other components normally forming the product mixture include unreacted di(-secondary alkyl) amine and secondary alkyl amine. Hereinbefore and hereinafter within the definition of the fabric softener composition of the invention there is included the crude mixture product as well as the purified ammonium ester derivative particularly since it is theorized that minor components of the crude mixture contribute to the fabric softening effect in addition to the principal ammonium derivative.

The ammonium derivative softeners of this invention may be utilized to treat a virtually unlimited variety of fabrics such, for example, as cotton, polyesters, nylon, viscose rayons, acetates, polyacrylonitriles, and the like. It is to be noted that for purposes of this invention, the terms "treatment", "treating", or "applying to " are meant to encompass both the coating and/or impregnation of the fabrics for the purpose of softening and/or fabric finishing. The padding technique is conventional in the textile art.

The fabric softening concentrate compositions of this invention are prepared by merely dispersing the desired ammonium ester derivative in water. Useful concentrations of ammonium ester derivative in the fabric softening concentrate composition may vary from about 1 to 10%, by weight, with 2 to 3% by weight, being preferred. It is to be noted that lower aliphatic alcohols such as ethyl alcohol and isopropyl alcohol may also be present in order to improve the dispersion of the ammonium derivative in water.

The fabric softening compositions may also be prepared in emulsion form. Thus, it is merely necessary to add the appropriate surfactant to the aqueous ammonium ester dispersion. Applicable surfactants include various types such as:

Examples of non-ionic emulsifiers include alkylphenoxypolyethoxyethanols having alkyl groups of about seven to eighteen carbon atoms and 6 to 60 or more oxyethylene units, such as heptylphenoxypolyethoxyethanols, octylphenoxynonylphenoxyethanols, dodecylphenoxypolyethoxyethanols, and the like; polyethoxyethanol derivatives of methylene-linked alkyl phenols; sulfur-containing agents such as those made by condensing 6 to 60 or more moles of ethylene oxide with nonyl, dodecyl, tetradecyl, t-dodecyl, and the like mercaptans or with alkylthiophenols having alkyl groups of six to fifteen carbon atoms; ethylene oxide derivatives of long-chained carboxylic acids, such as lauric, myristic, palmitic, oleic, and the like or mixtures of acids such as found in tall oil containing 6 to 60 oxyethylene units per molecule; analogous ethylene oxide condensates of long-chained alcohols, such as octyl, decyl, lauryl, or cetyl alcohols; ethylene oxide derivatives of etherified or esterified polyhydroxy compounds having a hydrophobic hydrocarbon chain, such as sorbitan monostearate containing 6 to 60 oxyethylene units, etc.; also, ethylene oxide condensates of long-chain or branched chain amines, such as dodecylamine, hexadecylamine, and octadecylamine, containing 6 to 60 oxyethylene groups; block copolymers of ethylene oxide and propylene oxide comprising a hydrophobic propylene oxide section combined with one or more hydrophilic ethylene oxide sections.

The fabric softening compositions may, if desired, contain a number of optional ingredients in order to modify certain of their properties. Thus, they may contain viscosity modifiers, colorants, perfumes, anti-foam agents, additional surfactants, and the like.

When used for consumer or commercial laundering, it is merely necessary to add the fabric softener to the rinse water during the laundering process. The softener is added in an amount such that the fabric is treated (uptake) with a minimum of about 0.1% of softener, based on the weight of the fabric, and preferably from about 0.25 – 1.0%, based on the weight of the fabric. The use of these prescribed amounts will insure the absence of a greasy feel and excessive softener buildup on the fabric.

When the softener is used as a finishing agent, it may be applied to the fabric by any effective technique whose use is desired by the practitioner. Thus, the fabrics may be treated by a "padding" technique wherein the fabric is passed through a solvent solution of the softener, squeezed through a nip and then briefly heated to evaporate the solvent. Typical solvents include isopropanol, acetone, methyl ethyl ketone and the like. The treated fabric is subsequently cured by heating at a drying temperature of from about 90° to 100° C. for a period sufficient to render the fabric dry. In addition, such surface coating techniques as spraying and brushing may also be effectively utilized in order to deposit a film of the softener on the surface of the substrate, i.e., fabric. Once again, the presence of as little as about 0.1% of softener additive, based on the weight of the fabric, will ordinarily provide adequately improved softening properties.

The following examples will further illustrate the embodiments of this invention but are not to be construed as limitations thereof.

EXAMPLE I

This example illustrates the preparation and use of a di(secondary alkyl) ammonium ester derivative typical of the softeners of this invention.

The di($C_{10}$–$C_{23}$ secondary alkyl) amine reactant employed herein was prepared by nitrating a mixture of paraffins of from 10 to 22 carbons ($C_{10}$–$C_{23}$) cut in accordance with the procedure set forth in U.S. Pat. No. 3,470,252.

The methyl sulfate derivative of di($C_{10}$–$C_{23}$ secondary alkyl) amine was prepared by adding one mole of dimethyl sulfate to one mole of the di($C_{10}$–$C_{23}$ secondary alkyl) amine over a period of about 1 hour at a temperature of 50° C. to form methyl di($C_{10}$–$C_{23}$ secondary alkyl) ammonium methyl sulfate.

The fabric softening effect of the above formed methyl sulfate derivative was determined on 14 × 28 samples of terry cloth. The fabric samples were placed in a washing machine (not more than 1.5 pounds dry weight) and thoroughly washed with detergent to remove any contaminants on the cloth. The washed samples were then thoroughly rinsed to remove all traces of detergent. The cloth samples were dried on a clothes line rather than in an electric dryer due to the inherent softening effect in electric drying. Prior to final rinse in softener, the cloth samples were soaked in water to insure adsorption rather than adsorption of the fabric softener composition.

The formed methyl di($C_{10}$–$C_{23}$ secondary alkyl) ammonium methyl sulfate was converted into a fabric softener composition by adding the sulfate product to water to form a 10% solution. Approximately 30 cubic centimeters of softener composition were added to the final rinse, thus corresponding to approximately 1.5 grams of active ingredient and an indicated take-up by the terry cloth sample of about 0.25% softener, by weight of cloth. Subsequent to the final rinse, which utilized tap water at a temperature of 100° F., the cloth samples were dried over night and then submitted to a test panel for softness evaluation with the highest degree of softness being indicated by a "1" rating. Terry cloth samples which were identically washed but were not rinsed in fabric softener were also submitted to the panel for evaluation as a control.

The panel rating results are indicated in the following table:

| Blank | Methyl Sulfate Softener |
|---|---|
| 5 | 1 |
| 5 | 2 |
| 5 | 1 |
| 5 | 1 |
| 5 | 2 |
| 5 | 2 |
| 5 | 2 |
| 5 | 1 |
| 5 | 1 |
| 5 | 1 |

These above evaluations clearly indicate the improved softness properties imparted by the novel fabric softeners of this invention.

EXAMPLE II

This example illustrates the preparation of dimethyl di(secondary $C_{10}$–$C_{23}$ alkyl) methyl sulfate.

Preparation of methyl di($C_{10}$–$C_{23}$ secondary alkyl) amine reactant was accomplished as a single step from nitroparaffins prepared as in Example I carrying $C_{10}$–$C_{23}$ radicals via a reductive alkylation with formaldehyde and hydrogen as indicated in the following equation:

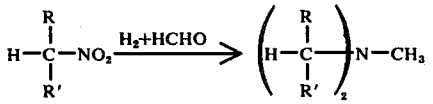

where R and R' are $C_{10}$–$C_{23}$ secondary alkyl. The di($C_{10}$–$C_{23}$ secondary alkyl) methyl amine was formed together with a certain samll amount of primary and secondary amine. The mixture was then reacted with dimethyl sulfate in accordance with Example I to form the principal product dimethyl di(secondary $C_{10}$–$C_{23}$ alkyl) ammonium methyl sulfate.

EXAMPLE III

This example illustrates the preparation of a $C_{20}$–$C_{23}$ secondary amine precursor employed in the preparation of the softeners contemplated herein. The procedure is equally appliable to the preparation of other fine cuts of di(secondary alkyl) amine such as $C_{10}$–$C_{14}$; $C_{14}$–$C_{15}$; and $C_{16}$–$C_{20}$ secondary amines.

Thirty grams of ($C_{20}$–$C_{23}$) nitroparaffin in 500 ml. methanol were heated with 20.4 grams 37% aqueous formaldehyde and 6.45 grams of Girdler G-69 catalyst for 15 hours at 200° F. under a hydrogen pressure of 500 lbs./in$^2$ in rocking bomb type pressure equipment. After cooling to room temperature, the catalyst was removed by filtration and the solvent removed under reduced pressure giving 22.0 grams of (90% yield) product. This product was shown to have 73 wt. % methyl di($C_{20}$–$C_{23}$ secondary alkyl) amine, 5.3 wt. % di($C_{20}$–$C_{23}$ secondary alkyl) amine, and 19 wt. % ($C_{20}$–$C_{23}$ secondary alkyl) amine. Analysis for ($C_{20}$–$C_{23}$ alkyl)$_2$N—$CH_3$ found the following:

| Element | Calc. | Found |
|---|---|---|
| C | 84.1 | 82.5 |
| H | 13.8 | 14.7 |
| N | 2.1 | 2.8 |
| TBN* | 84 | 100 |

*Total Base Number

EXAMPLE IV

The following di(secondary alkyl) ammonium ester derivatives representative of softeners contemplated herein were prepared by the general preparative procedures described hereinabove and tested for their fabric softening ability.

A — methyl monoethoxylated di($C_{10}$–$C_{14}$ secondary alkyl) ammonium methyl sulfate B — methyl monoethoxylated di($C_{10}$–$C_{14}$ secondary alkyl) ammonium dimethyl phosphate C — methyl di($C_{14}$–$C_{15}$ secondary alkyl) ammonium methyl sulfate Softeners A and B were then prepared as 2.5%, by weight, solutions in water:isopropanol while softener C was prepared as a 5.0%, by weight, aqueous solution. The fabric softener compositions were then subjected to the identical evaluation procedure set forth in Example I with the exception that cotton diaper material was substituted for the terry cloth. The results of these determinations are presented in the following table.

| Softener Composition | A | B | B | B | C | Blank |
|---|---|---|---|---|---|---|
| Amount added to rinse (c.c.) | 30 | 15 | 30 | 60 | 15 | — |
| Evaluation (Panel) | 2 | 6 | 3 | 1 | 5 | 7 |
| | 2 | 6 | 4 | 1 | 3 | 7 |
| | 2 | 3 | 4 | 6 | 1 | 3 |
| | 5 | 3 | 7 | 1 | 4 | 2 |
| | 1 | 5 | 2 | 4 | 3 | 7 |
| | 6 | 2 | 3 | 1 | 7 | 4 |
| | 3 | 4 | 3 | 1 | 7 | 5 |
| | 2 | 5 | 5 | 3 | 1 | 4 |
| | 6 | 7 | 4 | 1 | 2 | 3 |
| | 3 | 4 | 7 | 1 | 2 | 5 |

The results summarized above further show the improved softness characteristics exhibited by a substrate which has been treated with fabric softener compositions of this invention.

EXAMPLE V

This example further illustrates the effectiveness of the fabric softening compositions contemplated herein.

Two representative ammonium compounds, dimethyl di($C_{16}$–$C_{20}$ secondary alkyl) ammonium methyl sulfate (I) and dimethyl di($C_{20}$–$C_{23}$ secondary alkyl) ammonium methyl sulfate (II) soften cotton fabric as well as comparative commercially available imidazoline type fabric Y were tested. A further description of the employed compounds is as follows:

I. $(C_{16}\text{–}C_{20})_2N^+(CH_3)_2\ CH_3SO_4^-$

II. $(C_{20}\text{–}C_{23})_2N^+(CH_3)_2\ CH_3SO_4^+$

Y — Active ingredient 1-methyl-1-alkylamido- ethyl-2-alkyl imidazolinium methyl sulfate.

The softness of a test fabric was determined by having a panel of 12 people rate the softness of the fabric in descending order. Usually five test cloths are evaluated during one procedure, but sometimes fewer. A rating of one indicates that the fabric is the softest of those being evaluated. Testing was done with 0.125 gram softener/gram fabric. The following table summarizes the results obtained in these tests.

| PANELISTS | SOFTNESS PANEL RATINGS I | II | Y |
|---|---|---|---|
| 1 | 2 | 3 | 4 |
| 2 | 3 | 5 | 3 |
| 3 | 1 | 4 | 3 |
| 4 | 3 | 4 | 2 |
| 5 | 3 | 5 | 2 |
| 6 | 2 | 3 | 5 |
| 7 | 1 | 3 | 4 |
| 8 | 3 | 2 | 4 |
| 9 | 2 | 3 | 5 |
| 10 | 3 | 2 | 5 |
| 11 | 1 | 3 | 5 |
| 12 | 1 | 3 | 5 |
| AVG. | 2.1 | 3.3 | 3.9 |

Di(secondary alkyl) dimethyl ammonium methyl sulfates were established, as evidenced by the foregoing table, as most effective in communicating softness to the cotton fabric.

The di($C_{16}$–$C_{20}$ secondary alkyl) dimethyl ammonium sulfate has also proven to be significantly effective, when combined with certain detergents, notably linear alkyl benzene sulfonate detergent, as a softener when introduced onto cotton fabric in the wash cycle occurring in the conventional operation of a washing machine. Indeed the softening effect imparted by this combination was superior to that evidenced by mixtures of the same benzene sulfonate with equivalent amounts of commercially known quaternary salts, that is dihydrogenated tallow dimethyl ammonium chloride; dihydrogenated tallow dimethyl ammonium methylsulfate and a difatty imidazoline quaternary in one test procedure. While effective also as a rinse cycle softening agent the foregoing di($C_{16}$–$C_{20}$ secondary alkyl) dimethyl ammonium methyl sulfate has not evidenced superiority over the foregoing commercial quaternaries as a softening agent when introduced into treatment of cotton fabric at this stage of the washing machine cycle.

Fabric softening compositions such as the foregoing dihydrogenated tallow dimethyl quaternary ammonium salt incorporate a substantial disadvantage for many areas of application because of their water-proofing effect upon the textiles to which they are applied with any frequency. Thus, both towels or diapers repeatedly treated with the foregoing quaternary compounds have a reduced absorbency and are obviously less desirable for continued use than towels and diapers having their original wetting and absorbency properties.

This undesirable aspect of softener activity can be measured by a "wettability or wicking" test, wherein the ends of fabric strips previously treated with the softener compounds of interest are immersed in water containing a dye and the amount of wetting over a given time period determined by the height to which the strips become wet. Fabrics treated with materials imparting a "waterproofing" effect will show a pronounced decrease in the height to which the strip wets compared to an untreated strip of similar fabric. Wettability properties of cotton fabrics resulting from both wash cycle and rinse cycle treatment with di($C_{16}$–$C_{20}$ secondary alkyl) dimethyl ammonium methyl sulfate and the commercially available fatty quaternary compounds, dihydrogenated tallow dimethyl ammonium chloride and a difatty imidazoline quaternary ammonium salt are shown in the accompanying drawing wherein the foregoing compositions are identified by the numerical designations "1", "2" and "3" respectively.

It will be observed from the graph appearing in this drawing that the wetting properties of the test fabrics treated with the di(secondary alkyl) quaternary of this invention are similar to values obtained with a blank untreated fabric strip whereas the fabrics treated with the fatty derived quaternaries show significant decreases in fabric wetting, especially where the fabric was treated during a rinse cycle. While not wishing to be limited to any particular theory of operation, relatively higher wettability of fabrics treated during a wash cycle rather than the rinse cycle with the commercial fatty derived quaternaries, although less in either case than that secured with the di($C_{16}$–$C_{20}$ secondary alkyl) quaternary of the invention (Test Compound 1 of the drawing), is due to substantial removal of the quaternary from solution by the linear alkyl benzene sulfonate detergent incorporated in the washing operation, in accordance with conventional practice, resulting in a lesser amount of softener adsorbed on the cotton test cloth. The very low level of softening imparted by these fatty derived quaternaries during wash cycle application, as indicated above, supports this view.

The (secondary alkyl) quaternary salts of the present invention also accomplish their fabric softening role without imparting a yellow cast to the softened fabric.

In addition to fabric softening ability, the sulfate of the di(secondary alkyl) ammonium sulfate of this invention has certain biocidal activity which comes as a bonus in use of the compositions contemplated herein as fabric softeners.

In some evaluations against certain bacterial and fungus organisms, certain commonly encountered organisms were used as challenge materials namely: staphylococcus aureus, aerobacter aerogenes, aspergillus niger, trichophyton interdigitale, *oscillatoria sp.*, *ankistrodesumus sp.*

Specifically, it was found that the compounds such as the dimethyl sulfate derivatives displayed excellent biostatic and biocidal activity toward bacteria, fungi and algae. Standard test procedures to establish these properties were employed by forming fibrosen stat solutions in an appropriate solvent system, for example, 50% acetone and 50% deionized water and when the solution was required a 1% working solution was prepared from the stock solution by diluting with deionized water.

In the antibacterial testing the organisms were transferred for three successive days in Nutrient Bath (Difco) incubated at 30° C. One loopful of the final culture was transferred to sterile nutrient broth containing the desired level of chemical. Three hours after inoculation of the broth-chemical solution, a loopful was transferred to another tube of nutrient broth, and incubated at 30° C. for 48 hours. The absence of organisms in the sulculture indicated that complete kill of the organisms had occurred in the 3 hour contact period. In order to determine bacteriostatic activity of the chemical, the inoculated broth-chemical solution was incubated at 30° C. for 48 hours. Inhibition of growth was manifested by lack of turbidity in the medium.

It is thus seen that it is an adjunct to the fabric softening properties of the compounds, the antibacterial and antifungicidal activity are advantageous for the use of the composition on textile materials.

Summarizing, it is thus seen that this invention provides improved fabric softener compositions based on the di(secondary alkyl) ammonium ester derivatives contemplated herein. Variations may be made in proportions, procedures and materials without departing from the scope of this invention as defined by the following claims.

What is claimed is:

1. A fabric softener composition comprising an aqueous dispersion containing between about 0.1 and 10 wt. % of a di(secondary alkyl) ammonium ester derivative corresponding to the formula:

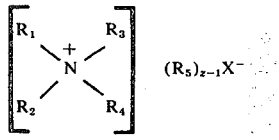

wherein $R_1$ and $R_2$ are the same and are $C_{10}$–$C_{30}$ secondary alkyl groups:

$R_3$ is selected from the group consisting of hydrogen, methyl, $(CH_2CH_2O)_nH$ group with $n = 3$;

$R_4$ and $R_5$ are selected from the group consisting of alkyl, aryl and aralkyl radicals of from 1 to 10 carbons, and X is an anion selected from the group consisting of sulfate and phosphate $z$ is an integer equal to the valence of X.

2. A composition in accordance with claim 1 in which the derivative is methyl di($C_{10}$–$C_{23}$ secondary alkyl) ammonium methyl sulfate.

3. A composition in accordance with claim 1 in which the derivative is methyl monoethoxylated di($C_{10}$–$C_{14}$ secondary alkyl) ammonium dimethyl phosphate.

4. A composition in accordance with claim 1 in which the derivative is methyl monoethoxylated di($C_{10}$–$C_{14}$ secondary alkyl) ammonium methyl sulfate.

5. A composition in accordance with claim 1 in which the derivative is a methyl di($C_{14}$–$C_{15}$ secondary alkyl) ammonium methyl sulfate.

6. A composition in accordance with claim 1 in which the derivative is dimethyl di($C_{16}$–$C_{20}$ secondary alkyl) ammonium methyl sulfate.

7. A composition in accordance with claim 1 in which the derivative is dimethyl di($C_{20}$–$C_{23}$ secondary alkyl) ammonium methyl sulfate.

8. A composition in accordance with claim 1 wherein said derivative is in the non-purified state derived from the reaction of di(secondary alkyl) amine and dihydrocarbyl sulfate or trihydrocarbyl phosphate.

* * * * *